US005636803A

United States Patent [19]

Aschmann et al.

[11] Patent Number: 5,636,803

[45] Date of Patent: Jun. 10, 1997

[54] APPARATUS FOR CHECKING THE WINDING QUALITY OF YARN BOBBINS AND USE OF THE APPARATUS ON A WINDING OR SPINNING MACHINE

[75] Inventors: Alfred Aschmann, Zumikon; Rolf Hensel; Hans Wampfler, both of Zürich, all of Switzerland

[73] Assignee: Zellweger Luwa AG, Uster, Switzerland

[21] Appl. No.: 330,788

[22] Filed: Oct. 28, 1994

[30] Foreign Application Priority Data

Oct. 29, 1993 [CH] Switzerland ..... 03262/93

[51] Int. Cl.[6] ..... B65H 63/00; B65H 54/02; G01N 21/00

[52] U.S. Cl. ..... 242/36; 242/35.5 R; 250/559.27; 250/559.45; 356/430

[58] Field of Search ..... 242/36, 28, 35.5 R; 356/238, 429, 430; 250/559.27, 559.28, 559.29, 559.45

[56] References Cited

U.S. PATENT DOCUMENTS

| | | | |
|---|---|---|---|
| 3,016,464 | 1/1962 | Bailey | 250/559.29 X |
| 3,584,225 | 6/1971 | Lindemann | 250/559.45 X |
| 3,592,400 | 7/1971 | Gith | 242/36 |
| 4,866,289 | 9/1989 | Kawamura et al. | 356/238 X |
| 4,924,406 | 5/1990 | Bergamini et al. | 242/36 X |
| 5,054,317 | 10/1991 | Laubscher | 356/238 X |
| 5,074,480 | 12/1991 | Aeppli | 242/36 |
| 5,184,453 | 2/1993 | Mima et al. . | |
| 5,224,172 | 6/1993 | Masai | 356/430 X |
| 5,278,635 | 1/1994 | Ono et al. | 356/429 X |
| 5,315,366 | 5/1994 | Inada et al. | 242/36 X |
| 5,337,138 | 8/1994 | Inada et al. | 356/238 X |

FOREIGN PATENT DOCUMENTS

| | | | |
|---|---|---|---|
| 41 12073 | 10/1991 | Germany . | |
| 42 16729 | 11/1992 | Germany . | |
| 62-15339 | 1/1987 | Japan | 242/36 |
| 64-13376 | 1/1989 | Japan | 356/238 |
| 5-178541 | 7/1993 | Japan | 242/36 |

OTHER PUBLICATIONS

Patent Abstracts of Japan vol. 10, No. 301 (M-525) 14. Oktober 1986 & JP-A-61 114 971 (Murata Mach Ltd) 2. Jun. 1986 * Zusammenfassung *.

Patent Abstracts of Japan vol. 17, No. 603 (M-1505) 5. Nov. 1993 & JP-A-05 178 541 (Toyobo Co Ltd) 20. Jul. 1993 * Zusammenfassung *.

*Primary Examiner*—Michael Mansen

*Attorney, Agent, or Firm*—Burns, Doane, Swecker & Mathis, LLP

[57] ABSTRACT

A number of sensors, each including a light source, illuminating and imaging optics and a detector, are arranged decentrally on a spinning or winding machine having a number of thread lines to provide online monitoring of the winding quality of a number of bobbins during the production of the bobbins. The sensors are preferably mounted on bobbin changers to traverse back and forth across a plurality of thread lines to examine a plurality of bobbins as they are being wound. These sensors are used on spinning or winding machines equipped with an electronic yarn-clearing system, with an interlinking of the measurement signals.

14 Claims, 4 Drawing Sheets

APPARATUS FOR CHECKING THE WINDING QUALITY OF YARN BOBBINS AND USE OF THE APPARATUS ON A WINDING OR SPINNING MACHINE

FIELD OF THE INVENTION

The present invention relates to an apparatus for checking the winding quality of yarn bobbins, with a sensor which has a light source for illuminating part of the surface of a yarn bobbin, means for imaging the illuminated part on a detector and an evaluation circuit for the signals generated by the detector.

BACKGROUND

An apparatus of this type, known from DE-A-4,216,729, and its counterpart U.S. Pat. No. 5,359,408 is designed as a test chamber, within which are arranged surface or image sensors formed by CCD cameras. During the examination, the bobbin to be examined rests on a stand and is illuminated in a floodlight manner by two light sources. As can be taken from DE-A-4,112,073, and its counterpart U.S. Pat. No. 5,289,983 the test chamber is arranged centrally for an entire spinning mill in the region of an intermediate store. This means that the bobbin testing takes place at a moment when an inadequate winding quality can no longer be corrected, but the particular bobbin has to be separated out as a reject. Apart from that, with this known apparatus, only the state of the outermost thread layer of the bobbin can be checked, and no evidence relating to the winding quality inside the bobbin is possible. Consequently, the possibility cannot be excluded, and it is even probable, that yarn bobbins judged to be good by this apparatus may have a poor winding quality.

OBJECT AND SUMMARY OF THE INVENTION

The invention will now specify a bobbin-testing apparatus, by means of which the winding quality, if possible of the entire bobbin in question, but at least of a large part of the particular bobbin, can be monitored. Moreover, the bobbin apparatus should be designed in such a way that a poor winding quality does not necessarily mean that the particular bobbin is separated out as unusable, but that correcting actions on the bobbin are possible.

This object is achieved, according to the invention, in that the apparatus contains a number of sensors of the type mentioned, and in that these are arranged decentrally on a spinning or winding machine and are provided for monitoring the winding quality during the production of the bobbin.

In the test apparatus according to the invention, therefore, instead of the provision of an individual central test chamber which is supplied with the finished bobbins after the spinning or winding process in time, there is on the spinning or winding machine a large number of decentral sensors which monitor the winding quality during the production of the bobbins. This means that the winding quality is monitored even inside the bobbin, and that correcting actions on the production process are possible. When it is remembered that rotor spinning machines and winding machines have an electronic yarn clearer at each spinning or winding position, then there is also the possibility of connecting the test apparatus according to the invention for the winding quality to the yarn-clearing system, as a result of which additional evidence as to quality can emerge.

The invention relates, furthermore, to a use of the apparatus mentioned on a winding or spinning machine equipped with an electronic yarn-clearing system. This use is characterized in that the signals from the apparatus for checking the winding quality and those from the yarn-clearing system are evaluated in consideration of one another and a functional relation between the two devices is made.

BRIEF DESCRIPTION OF THE DRAWINGS

The invention is explained in more detail below by means of exemplary embodiments and the drawings; in which.

DETAILED DESCRIPTION OF PREFERRED EMBODIMENTS

Figure 1:
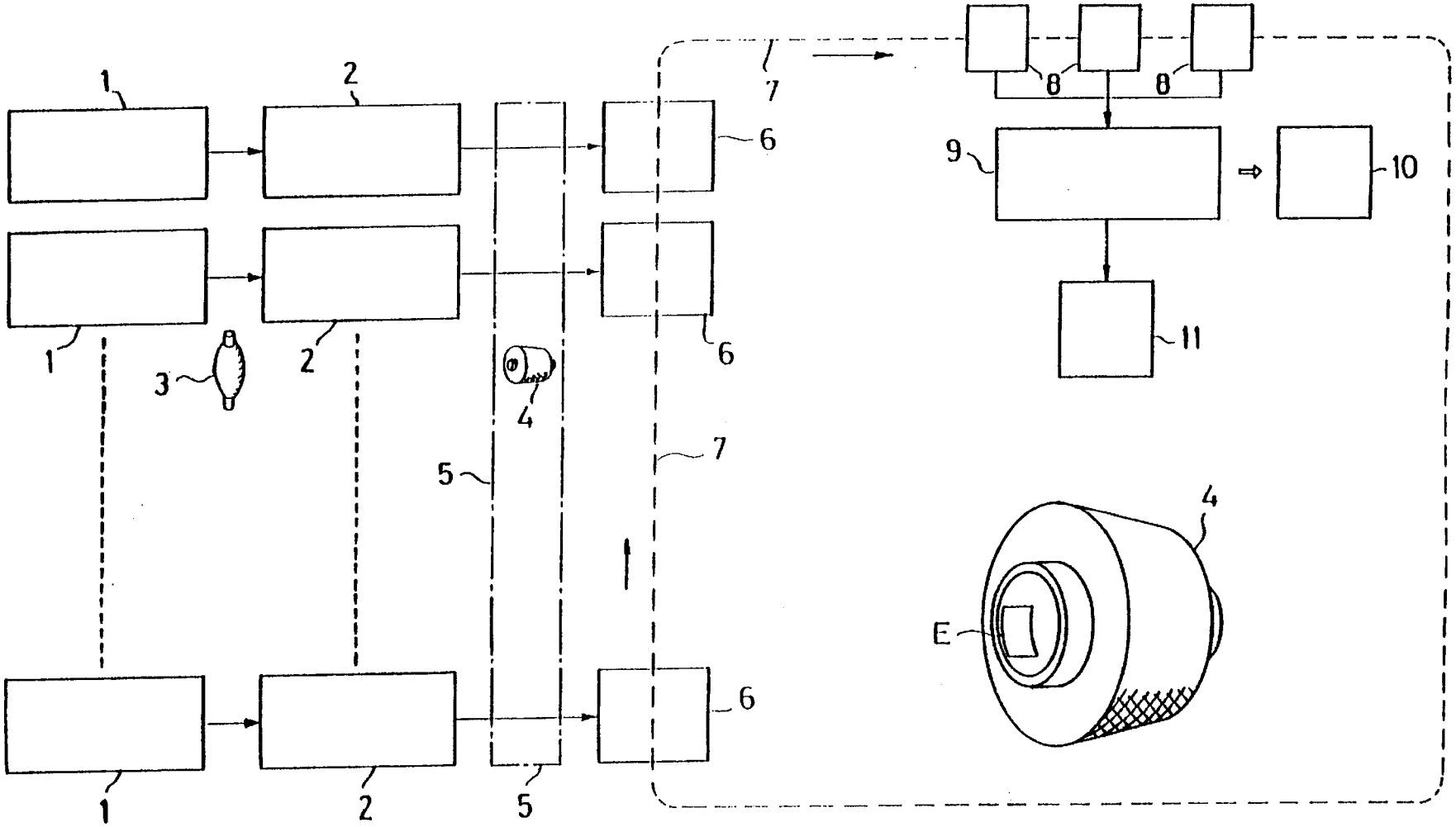
FIG. 1 shows a diagrammatic representation of a spinning/winding mill which is equipped with a bobbin-testing apparatus according to the state of the art.

In FIG. 1, a ting-spinning machine is designated by the reference symbol 1 and a winding machine by the reference symbol 2. A plurality of spinning machines 1 and winding machines 2, for example 40 in each case, are provided in the spinning mill, and each spinning machine 1 and each winding machine 2 comprises respectively a number of spinning or winding stations. Spinning bobbins 3 are produced on the spinning machines 1 and are transported by a transport system to the winding machines 2, where the spinning bobbins 3 are wound round to form cross-wound bobbins 4. When it is not a ring-spinning mill, but a rotor-spinning mill, the rotor spinning 1*b* machines produce cross-wound bobbins directly and there is no need for any winding machines.

The full cross-wound bobbins 4 are removed from the rotor spinning machines 1*b* or the winding machines 2 by a cross-wound bobbin changer 5 and are transferred from a loading device 6 of a transport device 7 represented by broken lines. The transport device 7 conveys the cross-wound bobbins 4 in the direction of the arrow as far as an unloading device 8 which receives the cross-wound bobbins from the transport device 7 and feeds them to a test station 9. In the test station 9, the state of the surface of the thread layers of the package is checked visually by a machine attendant and a optical test device. Bobbins with unacceptable faults are sorted out and pass into a suitable container 10 for rejects, and the bobbins of suitable quality are provided with a label E, are sorted and passed into an intermediate store 11.

This method of checking cross-wound bobbins in a central test station following the production process is the state of the art and described, for example, in DE-A-4,112,073, and its counterpart U.S. Pat. 5,289,983, the disclosure of which is incorporated herein by reference in its entirety. A suitable optical test device is known from DE-A-4,216,729, and its counterpart U.S. Pat. No. 5,359,408 the disclosure of which is incorporated herein by reference in its entirety.

The cross-winding test system according to the present patent application differs from the state of the art mentioned in that, among other things, the check of the cross-wound bobbins no longer takes place in a test station following the production process, but during the production process, specifically preferably in the region of the cross-wound bobbin changer 5. With a view to minimizing the costs, it is recommended to use a travelling sensor which serves a plurality of winding positions.

The travelling sensor can be mounted either on the cross-wound bobbin changer or, if one of these is not present, on a suitable travelling device. A cross-wound bobbin changer for 30 or 60 winding positions is provided on a winding machine and for approximately 120 spinning positions on a rotor-spinning machine. If it is assumed that a winding machine requires approximately 90 minutes for the production of a cross-wound bobbin, then, depending on the speed of the cross-wound bobbin changer, each bobbin is tested approximately 50 to 90 times during its production. In rotor-spinning machines, the test frequency is two to three times higher on account of the lower production speed. Even in the most unfavorable case, this is still orders of magnitude more than in the state of the art, where virtually only the outermost thread layer is checked. Of course, each winding or rotor-spinning position can also be provided with its own sensor.

Figure 2:
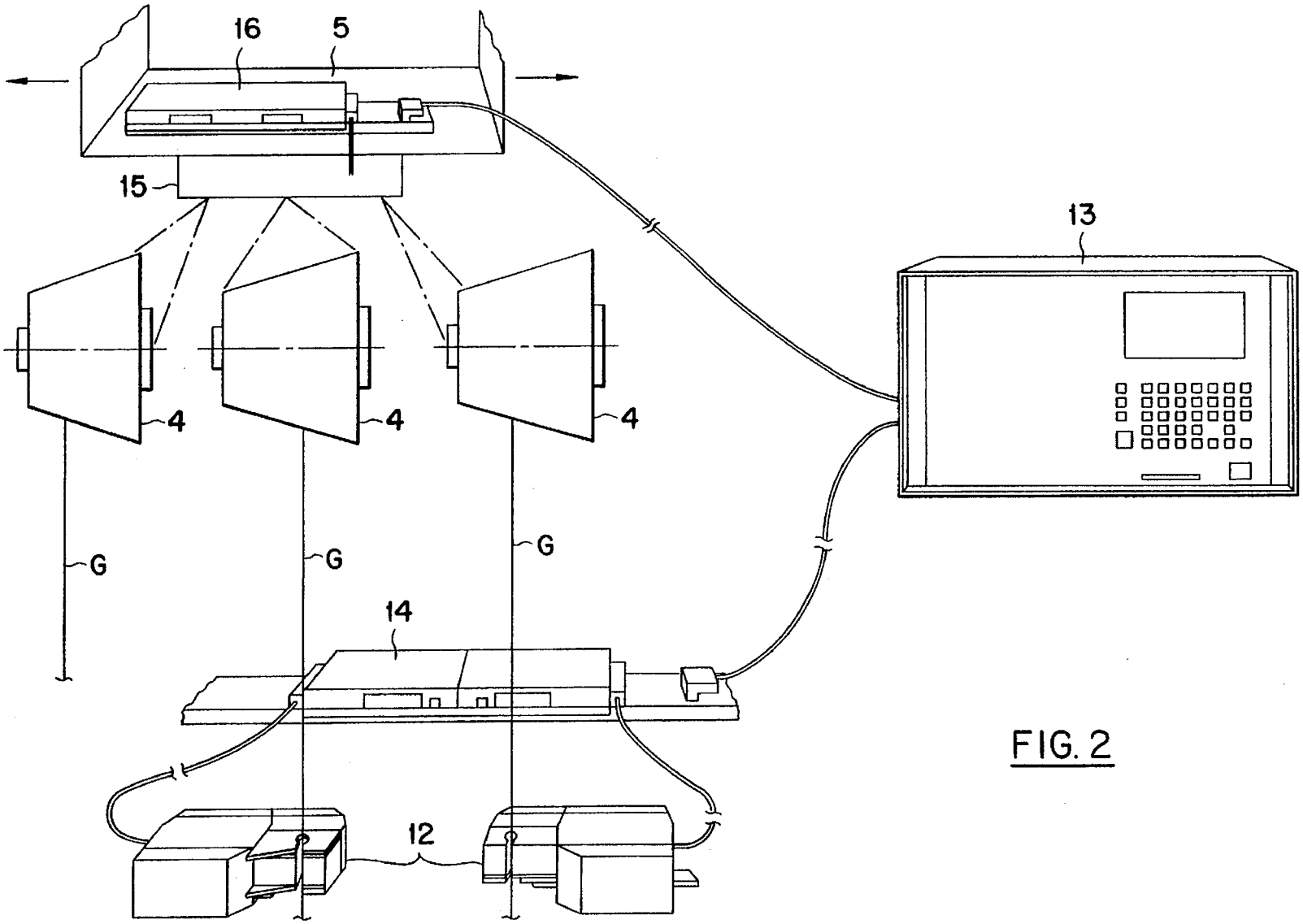
FIG. 2 shows a diagrammatic representation of part of a bobbin-testing apparatus according to the invention and of its positioning in the spinning/winding process.

FIG. 2 shows three cross-wound bobbins 4 which are just being wound with yarn G. The representation of the cross-wound bobbins 4 is greatly simplified. 0f course, a grooved drum, by which the respective crosswound bobbin is driven, is arranged at each production 5 station. Moreover, a sensor for determining the speed of the grooved drum and a sensor for determining the thread displacement on the cross-wound bobbin are preferably provided. A desired speed of the yarn G can be derived from the signals of the two sensors. The components mentioned are not explained in any more detail here; attention is drawn, in this respect, to U.S. Pat. No. 5,074,480, the disclosure of which is incorporated herein by reference in its entirety.

The yarn runs in a known way through the measuring heads 12 of a yarn-clearing system, for example of the type sold under the designation USTER POLYMATIC (USTER being a registered trademark) by Zellweger Uster AG. A yarn-clearing system of this type contains a central control unit 13 and, for each measuring head 12, an evaluation unit 14 connected to the respective measuring head 12 and to the control unit 13. Up to 84 evaluation units 14 are connected to the central control unit 13.

Arranged in the region of the winding stations is a travelling cross-wound bobbin changer 5 which travels continuously back and forth next to a specific number, (for example, 30 or 60) of winding stations and which removes the full cross-wound bobbins 4 from the winding machine 2 and transfers them to the loading device 6 (FIG. 1). Cross-wound bobbin changers of this type are known and will not be explained in any more detail here. A fact which is essential to the cross-wound bobbin changer 5 shown in FIG. 2 is that it contains, in addition to the known mechanism for bobbin handling, a sensor 15 for checking the winding quality of the cross-wound bobbins 4.

This sensor, which will be explained later by means of FIGS. 3 to 5, illuminates the cross-wound bobbins 4 and images them on a detector. Its signals are fed to a corresponding evaluation circuit 16. Such a cross-wound bobbin has a curved outer surface composed of a plurality of windings. In one embodiment, a light source illuminates a portion of this curved outer surface and the detector images the illuminated surface portion. In the exemplary embodiment illustrated, the evaluation circuit 16 is designed in the manner of the evaluation unit 14 of the yarn-clearing system and is mounted on the crosswound bobbin changer 5. The output of the evaluation circuit 16 is connected to a central control unit, in the illustration to the control unit 13, of the yarn-clearing system.

The purpose of checking the winding quality of the cross-wound bobbins 4 is to recognize winding faults of the cross-wound bobbins and therefore faulty production stations. As a result, a bobbin-fault classification of the cross-wound bobbins 4 can be carded out, and the bobbins can be marked with corresponding quality data. The marking preferably takes place by the contactless entry of the quality data in an information carder which is arranged on the bobbin and is formed by a machine-writable and machine-readable electronic memory chip and which would supplement or replace the label E of the cross-wound bobbin 4 shown in FIG. 1.

On the other hand, the bobbin-testing system also affords the possibility, when a fault is detected, of acting directly on the production process and cutting out the incorrectly wound piece of yarn (winding machine) or interrupting production at the respective rotor station (rotor-spinning machine). For these purposes, it is especially advantageous if an electronic yarn-clearing system is present on the spinning or winding machine, because the actions on the production process can then be carried out by the corresponding means of the yarn clearing system. Faulty pieces of yarn are removed by the vacuum or suck-off devices, present on the winding machine and on the rotor-spinning machine, as a result of a presetting of the yarn clearer or of the bobbin-testing system.

Of course, the bobbin-testing apparatus illustrated is, in principle, an independent test device which is not linked to the presence of a yarn-clearing system and which is also completely independent of the type or measurement principle of the yarn clearer. Likewise, the bobbin-testing apparatus need not be formed by a travelling sensor 15 arranged on the cross-wound bobbin changer 5, but a corresponding sensor could also be provided at each production station. A sensor of the type shown in FIGS. 3*a* to 5*b* could even be used in a central test station 9 (FIG. 1) also. In that case, there would be no on-line monitoring and no winding data from beneath the final bobbin surface. Therefore, much less quality data would be obtained, and also corrective action could not be initiated with respect to the production process. Nevertheless the system would be as efficient as the systems known at the present time. A precondition for the use of the sensors shown in FIGS. 3 to 5 in a central test station would be a device for rotating the bobbins.

By action on the production process is meant not only the elimination of faults by removal, but also the avoidance of faults by control. For example, the winding speed or the spinning speed may be regulated in dependence on the measured fault rate. A further possibility is the regulation of the bobbin density.

The cross-wound bobbin changer 5 can also perform further checking tasks. Thus, for example, each cross-wound bobbin 4 could be weighed by the bobbin changer 5 and, with the linear density of the yarn being known, the length of the wound thread could be determined from the weight.

The fault rate of the bobbin is composed of the faults of the yarn (yarn clearer) and of the faults of the package (bobbin-testing system). The two types of fault together supply a measure of all the faults or of the quality of the bobbin. The bobbin density can be checked by a joint signal processing of the bobbin testing system and of the yarn-clearing system. As is known, the control of the bobbin density takes place on the machine by means of a thread-tension device, by balloon control or by regulating the winding speed in dependence on the unwinding state of the cop. Basic quantities for the above-mentioned check of the bobbin density are the exact wound length (determined from various speed measurements), the thread lay, the absolute linear density of the yarn and the bobbin diameter. The bobbin density and its trend within the bobbin are also a measure of the thread tension and can be used for checking this, insofar as there is a check of the thread lay.

In contrast to the yarn faults, there are no assessment criteria for and there is also no generally acknowledged list of bobbin faults. If it is assumed that by a fault in the cross-wound bobbin is to be meant whatever is detrimental to the further processing and/or whatever reduces the quality of the final product, then the following list would in many instances name the most important bobbin faults:

knock-offs (fight ends on one of the two end faces)
ribbon windings
cauliflower (deformation fault)
residual threads, additional threads
tangled layers
radial deformation (ribbon breaking on the end face)
axial deformation (ribbon breaking on the cylindrical surface, so-called drum package)
variable appearance (color variations on the bobbin which are caused by changes in the raw material or a cop mix-up)
cleaning rings in the rotor-spinning mill
thread reserve (bottom, top)
bobbin density
tube color
bobbin diameter.

All these bobbin faults can be recognized without difficulty by means of the bobbin-testing device of FIG. 2. In use on the winding machines, the high rotational speed of the bobbins will mean that either stroboscopic illumination and, as a detector, a camera with image processing or an evaluation circuit 16 with correspondingly rapid signal processing is used. It is to be borne in mind, moreover, that the bobbins 4 monitored by a common sensor 15 usually have different diameters, and this has to be taken into account in any imaging of the bobbin surface on the receiver. This can take place in that the sensor has either sufficiently large depth of focus or an autofocus system, in practice only an autofocus system being considered on account of the relative size of the distance differences. At the same time, the signal for the autofocus setting can be used as a distance-measuring signal and the bobbin diameter can be derived from this.

Some exemplary embodiments of the sensor 15 will now be described. FIG. 2 shows that a sensor 15 mounted on the cross-wound bobbin changer 5 can observe specific parts of the cross-wound bobbins, particularly their end faces, only at an oblique angle. In order to guarantee a uniform image definition over the examined surface here during the imaging, for example the known Scheimpflug principle can be used for the imaging.

Moreover, image distortions must be compensated, and this can take place by a corresponding shaping of the sensor elements or by computation. The latter means that the detector is calibrated for a straight line, and that deviations from this are compensated by computation.

Since image processing is relatively expensive, this solution will usually be ruled out, and use will be made of specialized integrated optical sensors, for example photo-ASICs, which contain problem-matched optical detectors and in which, if appropriate, the evaluation electronics of parts of these are an integral part of the ASIC. The latter would, of course, entail a corresponding reduction in the evaluation circuit 16 (FIG. 2).

Figure 3A:
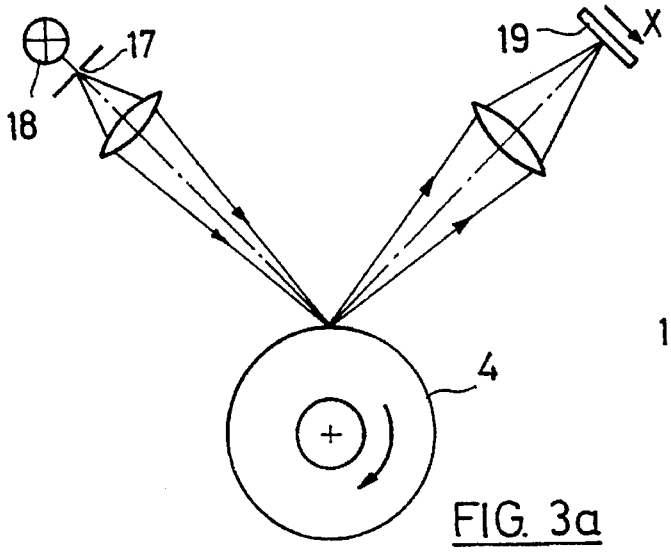
FIGS. 3*a* and 3*b* show diagrammatic representations of a first exemplary embodiment of the sensor of the apparatus of FIG. 2.
Figure 3B:
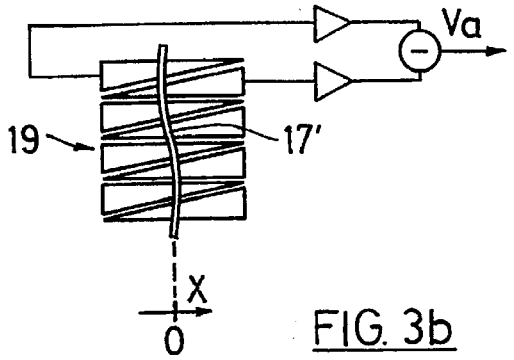

FIGS. 3*a* and 3*b* show diagrammatically a sensor which is especially suitable for the detection of laps on the cylindrical surface of the bobbins (caused, for example, by the thread jumping out of the traversing device) and of offsets on the end faces and for measuring curvatures of the end faces and of the winding surface. In this sensor, a light gap 17 is projected from a light source 18, for example a light-emitting diode (LED), onto the surface to be examined. If this surface is the cylindrical surface, the light gap 17 is preferably then projected parallel to the bobbin axis (arrangement according to FIG. 3*a*), and if it is an end face, projection takes place radially relative to the bobbin axis.

The surface to be checked is imaged on a detector row 19 by means of the light gap, and in this case the illuminating and imaging directions must be different. The individual elements of the detector row are sensitive to lateral displacements of the light distribution. Either a one-dimensional PSD (=position-sensitive detector) or a double-wedge detector according to FIG. 3*b* can be used as a detector. The latter consists of a number of double wedges, each of which forms a detector element. The output signals from the two double wedges of each detector element are interlinked, and the result Va of this interlinking amounts to zero volts when the image 17' of the light gap 17 is located in the middle of the detector element. In an off-center position, Va is proportional to the deflection of the image 17, in the direction designated by an arrow in FIGS. 3*a* and 3*b*.

Figure 4A:
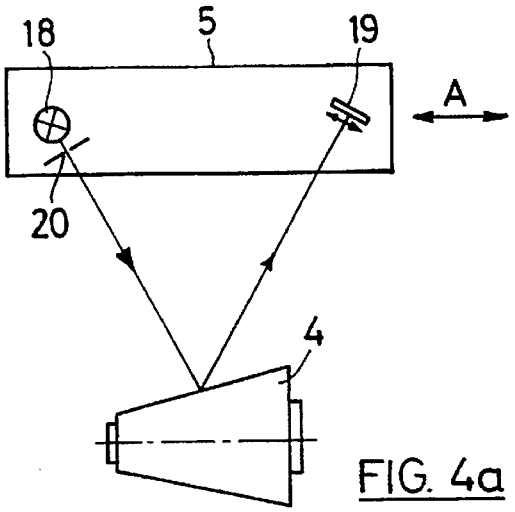
FIGS. 4*a* and 4*b* show diagrammatic representations of a second exemplary embodiment of the sensor of the apparatus of FIG. 2.

The method illustrated in FIGS. 3*a* and 3*b* is a modified triangulation method for distance measurement. A genuine triangulation method is shown in FIG. 4*a*. In this method, a light gap 17 is not projected onto the bobbin surface, but instead a perforated diaphragm 20, that is to say a light spot, the projection plane being oriented in the direction of the bobbin axis. The light spot projected obliquely onto the bobbin surface is imaged on a detector 19 (diode row, double wedge, position sensitive diode), the deflection again being a measure of the distance. Since the light transmitter 18 and detector 19 are arranged on the bobbin changer 5 movable in the direction of the arrow A, the entire bobbin surface is scanned during the to-and-fro movement of the bobbin changer 5.

Figure 4B:
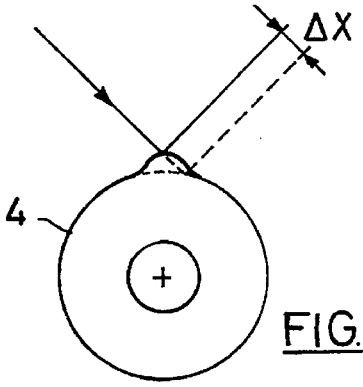

Ribbon breaking on the cylindrical surface of the bobbin 4 can be detected by means of a height-profile measurement according to FIG. 4*b*, a sufficiently high local resolution being a precondition of this method. In contrast to the lap which constitutes an elevation in the form of a thickness ring lying on the circumference, a ribbon breaking takes the form of an elevation of the thread-laying track, this elevation travelling up and down, when the bobbin rotates, in synchronism with the period of rotation of the bobbin. When the light beam projected onto the bobbin surface strikes such an elevation, the impact point of the light beam on the detector is displaced by the amount $\Delta x$. In an arrangement according to FIGS. 3*a* and 4*b*, where both a lap and ribbon breaking cause a displacement of the light beam striking the detector 19, the lap and ribbon breaking can be distinguished by means of an appropriate evaluation of the time-dependent and position-dependent signal.

Figure 5A:
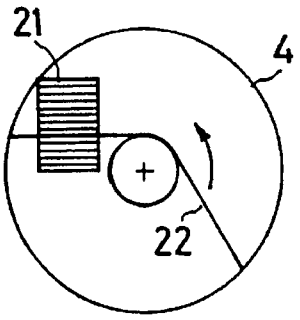
FIGS. 5*a* and 5*b* show two versions of a third exemplary embodiment of the sensor of the apparatus of FIG. 2.
Figure 5B:
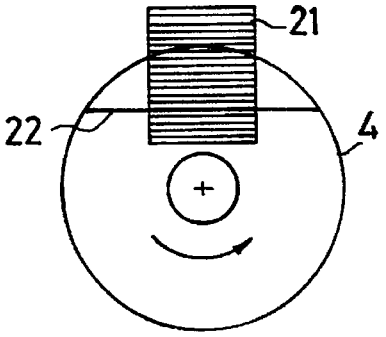
Figure 6:
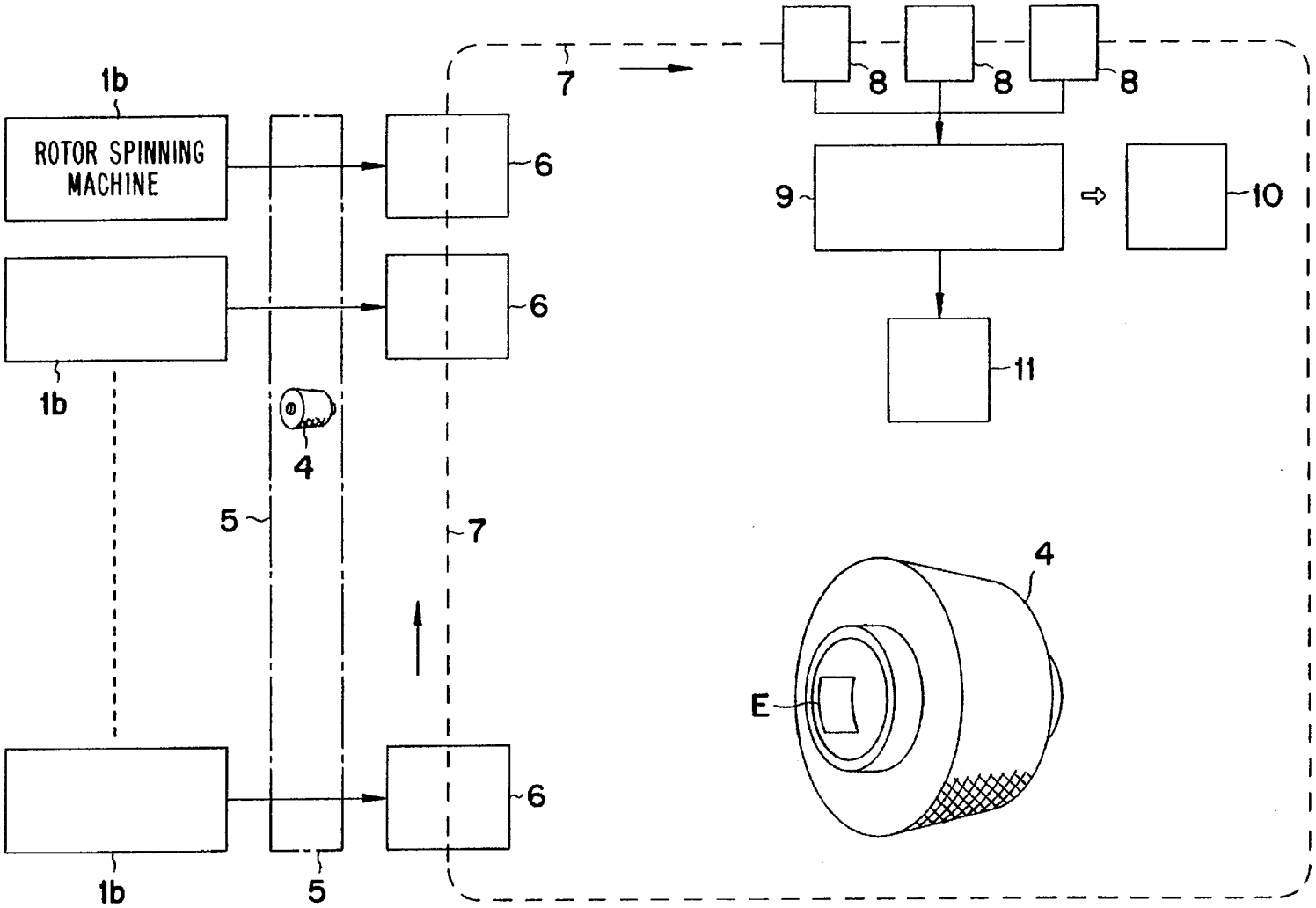
FIG. 6 is similar to FIG. 1 except that it represents a rotor-spinning mill rather than a ring-spinning mill.

FIGS. 5*a* and 5*b* show examples of the detection of knock-offs or tight ends which, as is known, lie stretched on the end faces. An oblique or glancing illumination is preferably selected here, so that the tight ends, by casting a long shadow, result in a sharper contrast. As a result of the rotation of the cross-wound bobbin 4, the signal is repeated periodically, and this can be utilized to increase measuring reliability if the measuring time is extended over a plurality of revolutions.

A cutout of the end faces is imaged on a line array sensor 21 which is arranged either off-center (FIG. 5*a*) or radially (FIG. 5*b*) to the bobbin axis. The individual elements of the linear-array sensor consist of narrow photoreceivers, for example photodiodes, the width of which corresponds to that of the east shadow. A fight end 22 which is present, depending on whether it is stretched (FIG. 5*b*) or deflected (FIG. 5*a*), will exactly cover once or twice respectively, during each revolution, those one to two photodiodes which correspond to its distance from the center of rotation. At this moment, a clear signal will be applied to the respective detector element, and the tight end 22 can be detected by means of a threshold-value shortfall. The particular region of the linear-array sensor 21 located outside the image of the bobbin end face is not taken into account in the evaluation. By means of a connected multiple arrangement of linear arrays, it is possible to adjust to the bobbin diameter up to a particular degree.

In contrast to the measuring arrangement according to FIGS. 5*a* and 5*b*, instead of a linear-array sensor which is relatively small in comparison with the bobbin end face, a large-area detector arranged behind a transparent LCD screen can be used or the LCD screen is imaged on a smaller detector. In either case, the obliquely illuminated end face is imaged on the LCD screen which, for example, is a display without a backplane mirror, and the screen is controlled in such a way that only one narrow linear array at a time is transparent. This linear array travels transversely over the screen, the measuring time for each position of the linear array amounting to at least one bobbin revolution. The advantage of this arrangement is that the length and width of the linear arrays can be programmed in a simple way, and that the length of the linear array can be matched optimally to the bobbin size.

Another version of a measuring arrangement could involve illuminating obliquely the surface to be checked (the cylindrical surface and/or end faces of the bobbin) and imaging it on a photodiode array arranged parallel to the bobbin axis. The long east shadow resulting from the oblique illumination results, at the output of the photodiodes, in a signal trend from which a multiplicity of winding faults can be recognized. This method, although incapable of recognizing all winding faults, is nevertheless simple and also cost-effective. And, like all the online methods described, it will surpass by orders of magnitude the known system under the central test chamber in terms of the evidential force of the measurement results.

The so-called variable appearance is measured by means of a color analysis of the yarn on the cylindrical surface, either different light wavelengths being radiated and the reflected light being analyzed by means of a detector or illumination being carried out with white light and the reflected light being analyzed by means of a plurality of detectors with different color filters. It is also possible to work with infrared or fluorescent radiation. In either case, during each pass of the bobbin changer, the color value for each bobbin is measured and stored and is compared with earlier measurements, an alarm being triggered above a particular deviation between the values.

Of course, the bobbin diameter too can be measured, and this can be carried out by means of standard methods, such as, for example, triangulation or a correcting signal of the autofocus.

A discussion of some examples of cooperation between a yarn-clearing system and bobbin monitoring also will be of interest.

A clearer measuring head of the type described in FIG. 3 of EP-A0,401,600 and its counterpart U.S. Pat. No. 5,054,317, the disclosure of which is incorporated herein by reference in its entirety, has both an optical measuring member and a capacitive measuring member which are arranged spaced apart from one another and which have spatially separated measuring zones. With such an arrangement, the yarn speed can be measured by means of a correlation method, so that a speed sensor function can be obtained in the evaluation unit. The thread speed fluctuates considerably (around 30 to 50%) during winding, but when the thread jumps out of the traversing device of the grooved drum in the known way in a lap, the thread speed remains approximately constant. The speed sensor recognizes this abnormal speed behavior and can emit a lap warning, or it can activate a sensor mounted on the bobbin changer for checking the state of the particular bobbin and, if appropriate, confirm the lap warning.

In the case of the speed measurement just described, the yarn speed can be integrated continuously in time in the evaluation unit of the yarn clearer. During each pass, the sensor on the bobbin changer measures the diameter of the bobbin. These two signals are interlinked in the control unit 13 (FIG. 2), and the interlinking gives the profile trend of the density over the entire bobbin.

Various speeds can be measured at the winding station, and evidence relating to the winding operation can be derived from these by arithmetic linkage. These speeds are, in particular, the rotational speed of the grooved drum, the horizontal thread-laying speed on the grooved drum, the desired speed of the yarn derived by means of the grooved drum and the thread-laying speed (see, in this respect, U.S. Pat. No. 5,074,480), and the instantaneous yarn speed determined by the optical/capacitive measuring head of the yarn-clearing system.

To improve the winding behavior, the winding speed is varied continuously. This variation, which is set on the machine, is designated as ribbon breaking. Moreover, a superposed speed change is obtained by means of the thread lay of the grooved drum, so that the instantaneous yarn speed changes according to different frequencies. These frequencies are the speed-change frequency attributable to the ribbon breaking and that attributable to the thread lay as well as the frequency components of the desired speed and of the instantaneous speed. Winding faults can be determined from a comparison between the two frequency components and can then be qualified more exactly by means of the bobbin-testing system. Although the observation of the speeds in the frequency range is highly computer-intensive, it is nevertheless easily possible with the current technical aids, such as, for example, digital signal processors (DSP).

A yarn clearer, which contains a foreign-fibre sensor of the type described in WO-A-93/19359 and its counterpart U.S. Pat. No. 5,414,520 (the disclosure of which is incorporated herein by reference in its entirety), continuously measures the degree of whiteness of the yarn. As soon as the foreign-fibre sensor detects a deviation, it activates the sensor on the bobbin changer which then, by means of its sensing equipment, checks the color value or the fluorescence of the yarn and decides whether the particular cop is to be eliminated. The advantage of this combination of the clearer and the bobbin tester is that the color recognition in the clearer, of somewhat restricted evidential value and therefore not completely reliable, is used only for preselection and not as a shut-down signal. This example makes it clear that the operating capacity and reliability of the clearer can be assisted considerably by the online bobbin testing described.

It is true, in general terms, that the sensing equipment and evaluations of the yarn-clearing system are integrated into the bobbin testing as an online early—warning system, and that the actual bobbin-testing system allows an exact qualification of the faults.

What is claimed is:

1. A spinning machine comprising a plurality of stations for winding a yarn at each such station into a succession of cross-wound bobbins, a travelling cross-wound bobbin changer moveable past a plurality of said stations for transferring full cross-wound bobbins from such stations toward a central discharge location, and a bobbin sensor carried by said bobbin changer and being moveable sequentially past the bobbins being wound at said stations to sense the quality of the individual cross-wound bobbins.

2. A spinning machine according to claim 1, wherein said sensor includes a light source carried by said bobbin changer and being moveable sequentially past the bobbins being wound at said stations to illuminate the windings of yarn at the surfaces of successive ones of said bobbins being wound as said bobbin changer moves past said bobbins, and wherein said bobbin sensor includes a detector receiving light reflected from said yarn windings.

3. A spinning machine according to claim 1, wherein said sensor moves past each bobbin a plurality of times while each cross-wound bobbin is being wounded.

4. A spinning machine according to claim 1, including a yarn clearer at each of said stations for sensing the yarn being wound into said cross-wound bobbins.

5. A method of producing numerous cross-wound yarn packages at a plurality of spaced apart winding stations, said method comprising forming at each such station a succession of full cross-wound yarn packages having outer surfaces composed of a plurality of yarn windings; sensing at least parts of the outer surfaces of said packages to provide information concerning the arrangement of yarn windings of the cross-wound yarn packages being wound at each of said stations; and transferring said full cross-wound yarn packages from all of said stations toward a central discharge location.

6. A method according to claim 5, wherein the arrangement of the yarn windings of each of the cross-wound yarn packages is sensed a plurality of times while such package is being wound.

7. A method according to claim 5, including sensing the uniformity of the yarn being wound at each of said stations.

8. Yarn package production apparatus comprising a plurality of spaced apart cross-wound bobbin winding stations for forming at each such station a succession of cross wound yarn packages having curved outer surfaces composed of a plurality of yarn windings, means for illuminating at least part of the outer curved surface of the yarn package being wound at each of such stations, and means for imaging at least parts of said illuminated surfaces of said yarn packages being wound to provide information concerning the arrangement of the yarn windings of the packages.

9. Yarn package production apparatus according to claim 8, wherein said stations are in a rotor spinning machine.

10. Yarn package production apparatus according to claim 8, wherein said means for illuminating includes a light source illuminating the yarn windings in the outer curved surface of a package being wound, and wherein said means for imaging includes a detector receiving light reflected from said yarn windings.

11. Yarn package production apparatus according to claim 8, wherein said means for imaging includes a detector at each of said stations.

12. Yarn package production apparatus according to claim 8, including a travelling support moveable successively past a plurality of said stations, and wherein said means for illuminating and said means for imaging are carried by said support to successively illuminate and image a plurality of packages being wound.

13. Yarn package production apparatus according to claim 12, wherein said support moves past each of said stations a plurality of times during the winding of each of said yarn packages.

14. Yarn package production apparatus according to claim 8, including a sensor at each of said stations through which the yarn being wound into the package at that station passes on its way to the package.

* * * * *